US007832811B2

(12) United States Patent
Kwon et al.

(10) Patent No.: US 7,832,811 B2
(45) Date of Patent: Nov. 16, 2010

(54) METHOD OF MANUFACTURING TOOTHBRUSH WITH NEEDLE-SHAPED BRISTLES AND TOOTHBRUSH MANUFACTURED BY THE SAME

(76) Inventors: Young-Jun Kwon, 4-7 Yadang-ri, Gyoha-myun 413-835 Paju, Gyunggi-do (KR); Sung-Wook Kwon, 201-7 Heukseok-1dong, Dongjak-gu, 156-861 Seoul (KR); Sung-Hwan Kwon, 201-7 Heukseok-1dong, Dongjak-gu, 156-861 Seoul (KR)

( * ) Notice: Subject to any disclaimer, the term of this patent is extended or adjusted under 35 U.S.C. 154(b) by 720 days.

(21) Appl. No.: 11/719,050

(22) PCT Filed: Dec. 10, 2004

(86) PCT No.: PCT/KR2004/003253

§ 371 (c)(1),
(2), (4) Date: Sep. 26, 2007

(87) PCT Pub. No.: WO2006/062265

PCT Pub. Date: Jun. 15, 2006

(65) Prior Publication Data

US 2008/0315669 A1 Dec. 25, 2008

(30) Foreign Application Priority Data

Dec. 8, 2004 (KR) ..... 10-2004-0103171

(51) Int. Cl.
*A46D 9/00* (2006.01)

(52) U.S. Cl. ..... 300/21; 300/2

(58) Field of Classification Search ..... 300/2, 300/21; 15/167.1, 207.2

See application file for complete search history.

(56) References Cited

U.S. PATENT DOCUMENTS

| | | | | |
|---|---|---|---|---|
| 5,533,227 | A * | 7/1996 | Ito et al. | 15/167.1 |
| 5,991,957 | A * | 11/1999 | Watanabe | 15/167.1 |
| 6,090,488 | A * | 7/2000 | Kweon | 428/399 |
| 2002/0116778 | A1 * | 8/2002 | Kwon | 15/167.1 |

* cited by examiner

*Primary Examiner*—Randall Chin
(74) *Attorney, Agent, or Firm*—Egbert Law Offices PLLC

(57) ABSTRACT

The present invention provides a method of manufacturing a toothbrush with needle-shaped bristles. The method includes the step of setting needle-shaped bristles, partially tapered by being immersed in a chemical, in a head part of a toothbrush body. The method further includes the step of grinding the needle-shape bristles using a drum grinder having protrusions (10) such that end points of the bristles range from 0.01 to 0.03 mm in thickness and tapered portions of the bristles range from 3.5 to 8 mm in length. A toothbrush, in which needle-shaped bristles having end points of 0.03 to 0.05 mm in thickness and tapered portions of 3.5 to 10 mm in length are set, can be manufactured using the method of the present invention. In the present invention, because a manufacturing process is simplified, the required production time and a defective proportion are markedly reduced.

7 Claims, 4 Drawing Sheets

METHOD OF MANUFACTURING TOOTHBRUSH WITH NEEDLE-SHAPED BRISTLES AND TOOTHBRUSH MANUFACTURED BY THE SAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates, in general, to methods of manufacturing toothbrushes with needle-shaped bristles and toothbrushes manufactured using the methods and, more particularly, to a method of manufacturing a toothbrush with needle-shaped bristles which enhances the workability thereof, and a toothbrush with needle-shaped bristles having improved penetration ability and flexibility.

2. Description of Related Art Including Information Disclosed Under 37 CFR 1.97 and 37 CFR 1.98

Generally, needle-shaped bristles, which have sharp ends and are set in a toothbrush, have superior flexibility and the ability to penetrate into gaps between teeth or into periodontal pockets, compared to normal bristles with end points which are round. Thus, recently, needle-shaped bristles have been set in almost all high quality toothbrushes.

In methods of manufacturing such needle-shaped bristles, there are methods: (i) in which end points of bristles are dissolved using a strong alkali chemical or strong acid chemical, (ii) in which bristles are ground using a grinder after a bristle setting process has been conducted, and (iii) in which bristles are partially tapered using the method (i) and are then additionally grounded using the method (ii).

High quality needle-shaped bristles, which are tapered such that the length of the tapered portions of the bristles are relatively long, that is, 5 mm or longer, and the thickness of end points of the bristles are approximately 0.01 mm, can be produced through the method (i). Because the tapered portions of these needle-shaped bristles are relatively long, the flexibility thereof increases. Furthermore, the end points of the bristles are relatively thin, so that the penetration ability is superior. However, it is very difficult to adjust the precise time required to dissolve the bristles. Also, there is the problem of an increased number of defective products.

In the case of the method (ii), the workability is increased, but because tapered portions of produced needle-shaped bristles are relatively short, that is, 2 mm, the flexibility is poor. As a result, there is a problem of damage to the gums of a user.

The method (iii) is advantageous in that it solves some problems of the methods (i) and (ii). This method (iii) was proposed in Korean Patent No. 261658 and Korean Patent No. 421454, which were filed by the inventor of the present invention. Korean Patent No. 261658 proposes a method, in which bristles are immersed and dissolved in a strong acid chemical or a strong alkali chemical until just before the length of the bristles is reduced and, thereafter, the partially tapered bristles are washed in water and dried, and then set in a head part of a toothbrush after being ground using a grinder. The needle-shaped bristles produced by this method are relatively long, that is, approximately 5 mm, so that the flexibility thereof is superior. However, because the thickness of the end points of the bristles ranges from 0.04 to 0.08 mm, that is, because the thickness of the end points is relatively large, the penetration ability is poor. If the grinding process is further conducted to reduce the thickness of the end points of the bristles, the length of the tapered portions of the bristles is reduced, thus resulting in poor flexibility.

Korean Patent No. 42154 is similar to Korean Patent No. 261658. In this case, bristles are ground such that the thickness of end points of bristles is 0.02 mm or less in order to enhance the penetration ability. However, this case is problematic in that, because the length of tapered portions of the bristles ranges from 2.8 to 3.5 mm, the flexibility is poor. Furthermore, there is a problem in that the number of defective products increases in this manufacturing process.

That is, it has been very difficult to produce needle-shaped bristles having both increased penetration ability and flexibility through the conventional immersion and grinding processes.

BRIEF SUMMARY OF THE INVENTION

Technical Problem

Accordingly, the present invention has been made keeping in mind the above problems occurring in the prior art, and an object of the present invention is to provide a toothbrush with needle-shaped bristles having improved penetration ability and flexibility. Another object of the present invention is to provide a method of manufacturing toothbrush with needle-shaped bristles in which a manufacturing process is simplified and the defective proportion is markedly reduced.

Technical Solution

In an aspect, the present invention provides a method of manufacturing a toothbrush, including: setting needle-shaped bristles, partially tapered by immersing end points of the bristles in a chemical, in a head part of a toothbrush body; and grinding the needle-shape bristles using a drum grinder having protrusions. In another aspect, the present invention provides a method of manufacturing a toothbrush including: grinding a bundle of partially tapered needle-shaped bristles using a drum grinder having protrusions; and setting the bristles in a head part of a toothbrush body. The needle-shaped bristles of the toothbrush manufactured using the method of the present invention have end points ranging from 0.01 to 0.03 mm in thickness and tapered portions ranging from 3.5 to 8 mm in length.

ADVANTAGEOUS EFFECTS

As described above, the present invention provides a method of manufacturing a toothbrush with needle-shaped bristles which have end points ranging from 0.01 to 0.03 mm in thickness and tapered portions ranging from 3.5 to 8 mm in length. In the method of the present invention, because the manufacturing process is simplified, the production time and the defective proportion of bristles are markedly reduced.

DETAILED DESCRIPTION OF THE INVENTION

Hereafter, the present invention will be described in detail.

Figure 1:
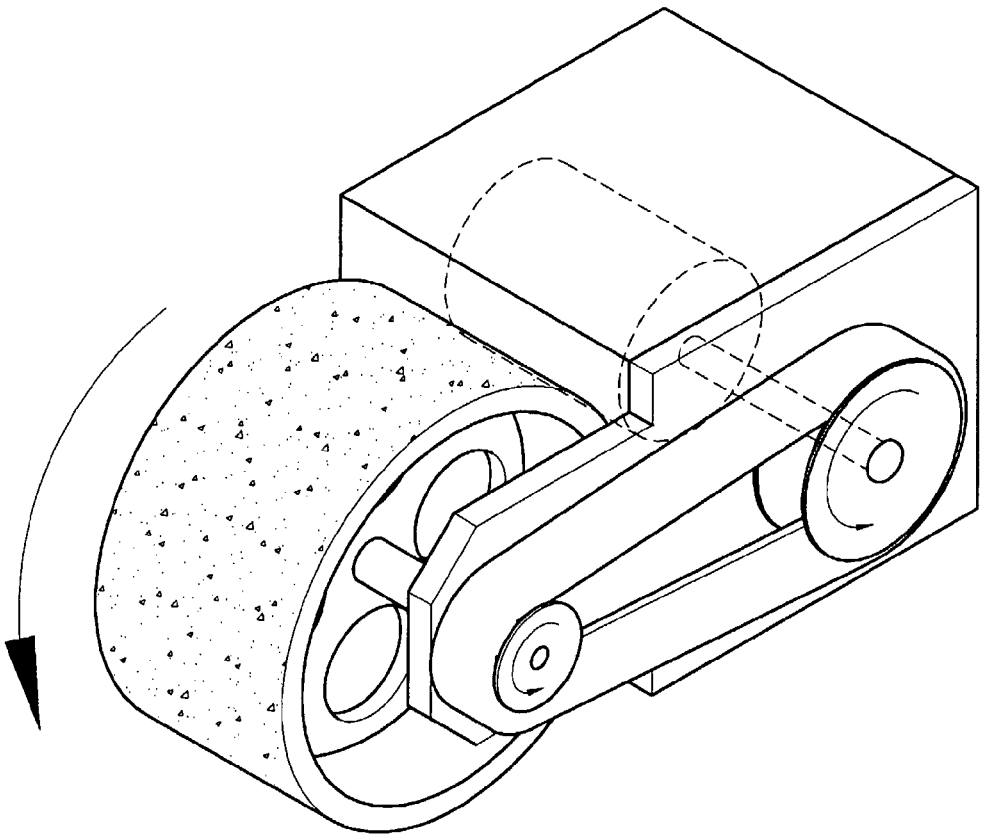
FIG. 1 is a perspective view showing a conventional drum grinder.

A typical grinder has a structure shown in FIG. 1. The surface of the grinder is coated with grind stones such as diamonds. This drum grinder has a planar surface and grinds an object by rotating. The patents, which were filed by the inventor of the present invention, disclose the same kind of grinders, and these grinders grind bristles which are previously partially tapered. However, it is very difficult to produce bristles, end points of which have a thickness of 0.03 mm and tapered portions of which have a length of 3.5 mm, using the above-mentioned grinders. The reason is that, if bristles are heavily ground by a grinder in order to reduce the thickness of the end points of the bristles, the length of tapered portions of the bristles is excessively reduced, and, conversely, if the bristles are ground such that the length of tapered portions is maintained within a desired range, the thickness of the end points is increased.

Figure 2:
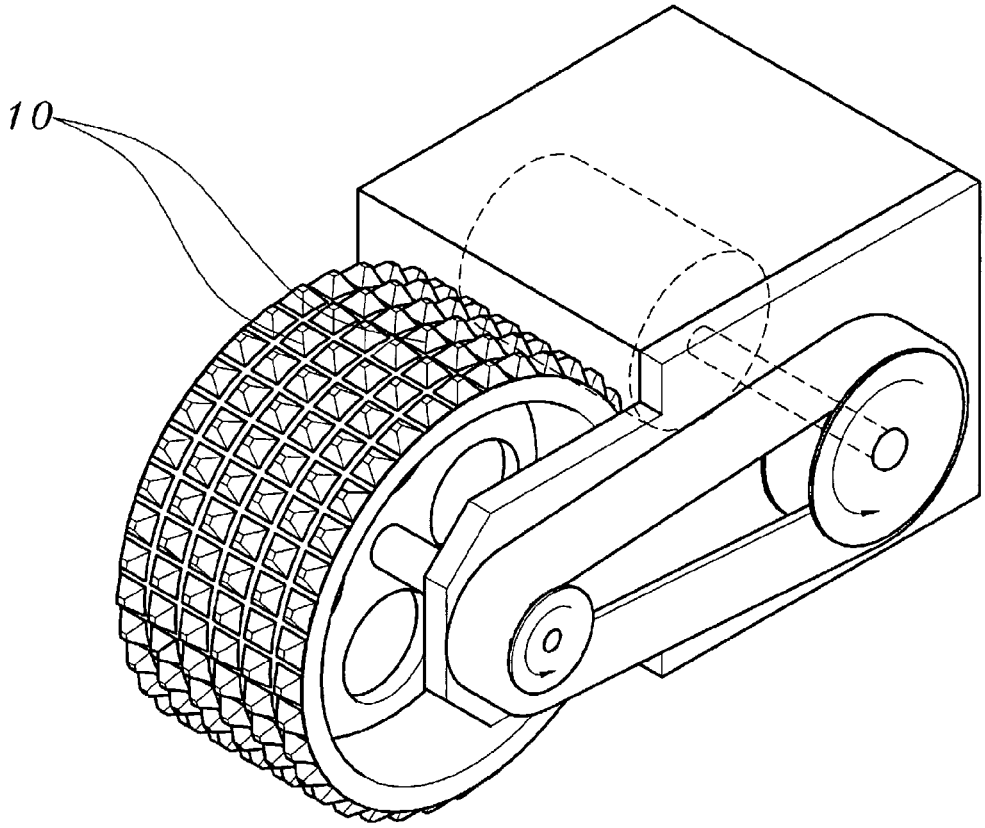
FIG. 2 is a perspective view of a drum grinder having a plurality of protrusions, according to the present invention.

As shown in FIG. 2, a grinder used in a manufacturing method of the present invention has a plurality of protrusions 10 thereon. The height of each protrusion may be appropriately adjusted within a range from 2 to 10 mm.

Intervals between protrusions 10 are not limited to a particular range, but a range from approximately 2 to approximately 5 mm is appropriate. Preferably, each protrusion 10 has a mountain top shape, a lower portion of which has a larger cross sectional area and an upper portion of which has a smaller cross sectional area. Alternatively, each protrusion 10 may have a cylindrical shape. In the case that each protrusion 10 has a mountain top shape, an end thereof is preferably rounded. The reason is that bristles to be machined may be undesirably cut by sharp end points of the protrusions.

Figures 3A, 3B:
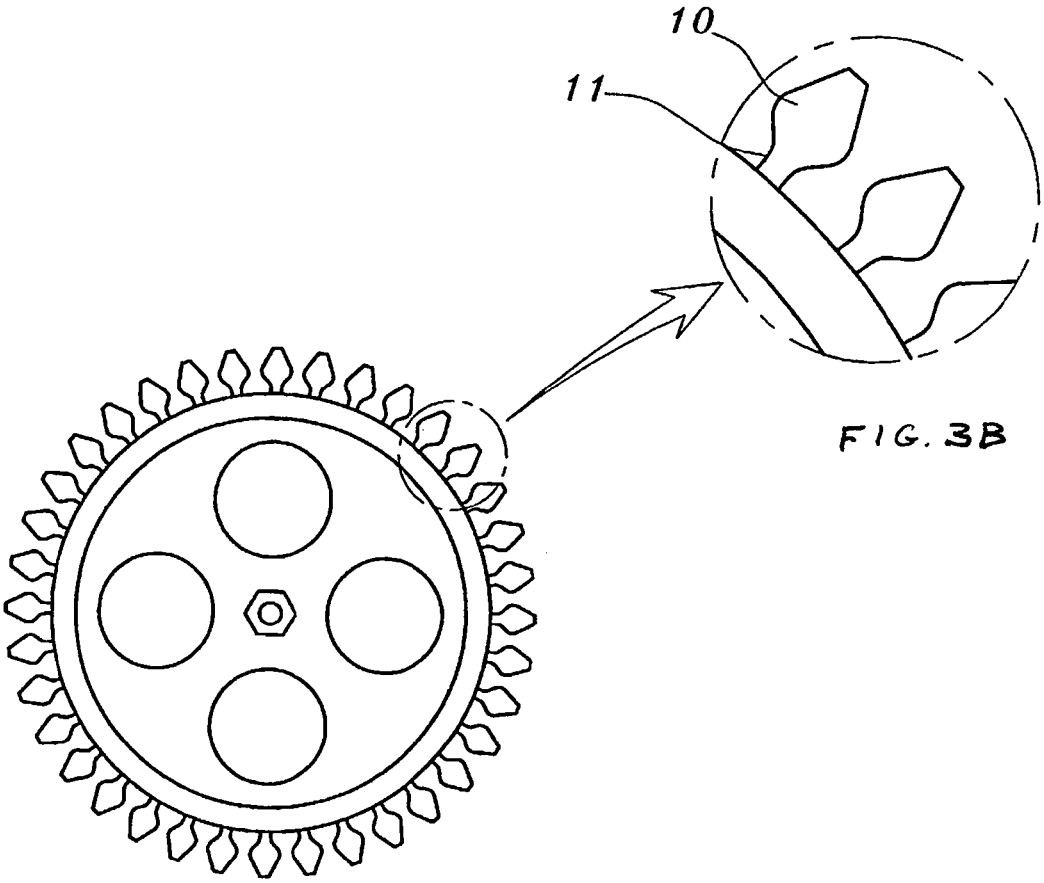
FIG. 3A is a front view showing an example of the shape of the protrusions of the drum grinder according to the present invention.
FIG. 3B is a magnified view of the protrusions of the drum grinder shown in FIG. 3A.

Overall, each protrusion 10 has a mountain top shape but, more preferably, each protrusion 10 may have a slender base 11, as shown in FIGS. 3A and 3B.

The slender bases 11 of the protrusions 10 serve to prevent ends of bristles from being excessively ground. The surface of each protrusion 10 is coated with grind stones in the same manner as that of the conventional grinder. The grinder may be constructed such that the grind stones are embedded in the surface of the grinder.

If the above-mentioned drum grinder having protrusions 10 is used, the thickness of end points of bristles can be reduced to a desired range despite maintenance of the length of tapered portions of the bristles. The reason is that the grinder having protrusions 10 can evenly grind end points of bristles to a length corresponding to the height of the protrusions 10, unlike a conventional drum grinder, which grinds only end points of bristles due to its planar surface. Furthermore, if the grinder having protrusions 10 rotates for a predetermined time and then rotates in reverse, relatively satisfactory bristles can be obtained.

Figure 4:
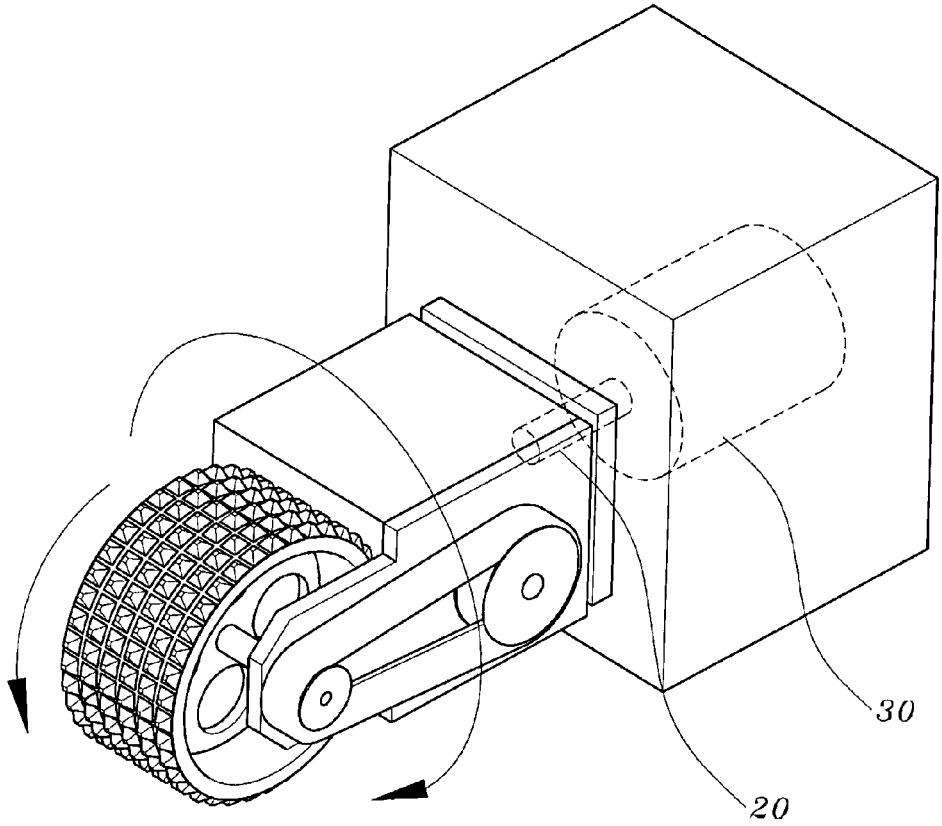
FIG. 4 is a perspective view of the drum grinder coupled to a rotor, according to the present invention.

However, to obtain more satisfactory bristles, a grinder, which is able to rotate even in a transverse direction, is required. A grinder having this structure is shown in FIG. 4. In this drawing, the drum grinder, having protrusions 10, is coupled to a rotating shaft 20 of a rotor 30. The rotor 30 rotates in a transverse direction while the grinder rotates in a longitudinal direction. In the case of the grinder which is able to rotate in both longitudinal and transverse directions, the whole grinder is evenly involved in a grinding operation, compared to a grinder which is able to rotate in only one direction. As a result, the grinder is prevented from being unevenly worn, so that its expected life span is extended. Furthermore, because the grinder can evenly grind bristles, the time required to finish a tapering process is reduced. Moreover, the grinder can grind bristles, such that the thickness of the end points of the bristles becomes approximately 0.01 mm despite the length of the tapered portions of the bristles being maintained.

In a manufacturing method according to another embodiment of the present invention, a bundle of needle-shaped bristles, which were previously partially tapered, is ground by a drum grinder having protrusions 10 before being set in a head part of a toothbrush. "A bundle of needle-shaped bristles which were previously partially tapered" means a bundle of bristles made by partially dissolving end points of the needle-shaped bristles, each of which has a length ranging from 32 to 33 mm, using a chemical and by tying it in a cylindrical shape having a diameter ranging from 30 to 50 mm. Such a bundle of needle-shaped bristles is ground by the drum grinder having protrusions 10 and is then set in the head part of the toothbrush. This manufacturing method has the advantage of a reduction in the time required to grind the bristles. Particularly, the method is effective in manufacturing a toothbrush in which needle-shaped bristles, each of which is tapered, are set.

Several examples according to the present invention are as follows.

Example 1

Partially tapered needle-shaped bristles were manufactured by immersing and dissolving end points of bristles in a chemical, such that the partially tapered needle-shaped bristles had end points ranging from 0.03 to 0.04 mm in thickness and tapered portions of 7 mm in length. Thereafter, the partially tapered needle-shaped bristles were set in a head part of a toothbrush. Subsequently, the bristles, which were set in the toothbrush, were tapered by grinding them at 200 rpm for four seconds using eight drum grinders, each of which has a structure of FIG. 2, in which protrusions, each having a height of 5 mm, are provided on the surface of the grinder and are spaced apart from each other at intervals of 3 mm. As a result, the thicknesses of the end points of the manufactured needle-shaped bristles range from 0.01 to 0.03 mm. The lengths of the tapered portions of the needle-shaped bristles range from 4 to 5 mm.

Example 2

The second example was conducted in the same method as the first example, but using a grinder of FIG. 4 which is able to rotate in both longitudinal and transverse directions. Here, a transversely rotating speed was 300 rpm, and the time required to grind bristles was two seconds. In this case, the thicknesses of the end points of the manufactured needle-shaped bristles range from 0.01 to 0.02 mm. The lengths of the tapered portions of the needle-shaped bristles range from 6 to 7 mm.

Comparative Example

This example was conducted in the same method as the first example, but using a typical drum grinder having no protrusions. In this case, the thicknesses of the end points of the manufactured needle-shaped bristles range from 0.015 to 0.02 mm. The lengths of the tapered portions of the needle-shaped bristles range from 2.7 to 3.2 mm.

Example 3

A bundle of partially tapered needle-shaped bristles, each of which has a length of 33 mm, (the diameter of the bundle is 35 mm) was ground in the same manner as the second example, for 56 seconds (28 seconds for each end of the bundle), such that the partially tapered needle-shaped bristles have end points ranging from 0.01 to 0.02 mm in thickness and tapered portions ranging from 6 to 7 mm in length. Thereafter, the manufactured bundle of partially tapered needle-shaped bristles was set in a head part of a toothbrush, thus obtaining a toothbrush having the same shape as that of the second example.

However, in this example, one bundle of needle-shaped bristles can be set in fifty-eight toothbrushes. Therefore, the grinding time of the bristles is markedly reduced, to 0.97 seconds per toothbrush, compared to the second example, in which the grinding time of the bristles is 2 seconds per toothbrush.

The invention claimed is:

1. A method of manufacturing a toothbrush comprising:

forming a plurality of bristles by immersion in a chemical such that each of said plurality of bristles has a sharp end and a tapered portion extending from said sharp end, said sharp end having a thickness of 0.03 to 0.05 millimeters, said tapered portion having a length of between 3.5 to 10 millimeters in length;

setting said plurality of bristles in a head portion of the toothbrush; and grinding the sharp end and the tapered portion of said plurality of bristles with a drum grinder such that the ground end has a thickness of between 0.01 and 0.03 millimeters and such that the ground tapered portion has a length of between 3.5 and 8 millimeters, said drum grinder having a plurality of protrusions extending outwardly therefrom.

2. The method of claim 1, further comprising:

coupling said drum grinder to a rotor such that said drum grinder rotates in a longitudinal direction and such that said rotor simultaneously rotates in a transverse direction.

3. The method of claim 1, each of said protrusions having a height of between 2 and 10 millimeters.

4. The method of claim 1, each of said protrusions having a shape of a mountain top, each of said protrusions having a lower portion with a cross-sectional area that is larger than a cross-sectional area of an upper portion thereof.

5. The method of claim 4, each of said plurality of protrusions having a base.

6. A method of manufacturing a toothbrush comprising:

tapering a bundle of bristles by immersion in a chemical, the tapering being along a portion of a length of each of the bristles, each of the bristles in said bundle having a pointed sharp end;

grinding the bundle of bristles by a drum grinder, said drum grinder having a plurality of protrusions extending outwardly therefrom; and setting the ground bundle of bristles in a head portion of the toothbrush.

7. The method of claim 6, further comprising:

coupling said drum grinder to a rotor such that said drum grinder is rotatable in a longitudinal direction while said rotor simultaneously rotates in a transverse direction.

* * * * *